US011111560B2

(12) United States Patent
Ghanimian et al.

(10) Patent No.: US 11,111,560 B2
(45) Date of Patent: Sep. 7, 2021

(54) GREY GOLD ALLOY

(71) Applicant: Simon G. Jewelry, Inc., Glendale, CA (US)

(72) Inventors: Simon Ghanimian, Sherman Oaks, CA (US); Zaven Ghanimian, Encino, CA (US)

(73) Assignee: SIMON G. JEWELRY, INC., Glendale, CA (US)

( * ) Notice: Subject to any disclaimer, the term of this patent is extended or adjusted under 35 U.S.C. 154(b) by 197 days.

(21) Appl. No.: 16/257,059

(22) Filed: Jan. 24, 2019

(65) Prior Publication Data

US 2019/0226056 A1 Jul. 25, 2019

Related U.S. Application Data

(60) Provisional application No. 62/621,485, filed on Jan. 24, 2018.

(51) Int. Cl.
*C22C 5/02* (2006.01)

(52) U.S. Cl.
CPC ..... *C22C 5/02* (2013.01)

(58) Field of Classification Search
CPC ..... C22C 5/02
See application file for complete search history.

(56) References Cited

U.S. PATENT DOCUMENTS 5,045,411 A * 9/1991 Taylor ..... C22C 5/08 428/672

FOREIGN PATENT DOCUMENTS

KR 20090071372 A * 7/2009
RU 2604148 C1 * 12/2016

OTHER PUBLICATIONS

English machine translation of RU 2604148 C1 of Kostin published Dec. 2016. (Year: 2016).*
English machine translation of KR 20090071372 A of Shimizu published Jul. 2009. (Year: 2009).*

* cited by examiner

*Primary Examiner* — Jophy S. Koshy
(74) *Attorney, Agent, or Firm* — Tucker Ellis LLP

(57) ABSTRACT

Described herein is a metal alloy comprising 50% to 60% by weight gold, 20% to 40% by weight palladium, and 0.1% to 24% by weight silver. Further, the metal alloy disclosed has a grey gold hue. Also described is an item of jewelry of the disclosed metal alloy.

13 Claims, No Drawings

GREY GOLD ALLOY

CLAIM OF PRIORITY

This application claims the benefit of priority to U.S. Provisional Patent Application No. 62/621,485, titled "Grey Gold Alloy," filed Jan. 24, 2018, which is herein incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

Embodiments of the invention are generally related to metal alloy compositions that possess a grey gold hue, and more particularly, to metal alloy compositions comprising gold, palladium, and silver.

BACKGROUND

Embodiments of the present invention relate to metal alloys for use in making ornamental jewelry, jewelry casting, and other applications. Alloys used in making jewelry items and jewelry components are generally selected based on criteria such as hue, castability, ductility, strength, hardness, tarnish, and corrosion resistance. For example, it is desirable for the alloy to be sufficiently deformable to work with easily, to exhibit an aesthetically pleasing color and brightness, and to possess a sufficient hardness and corrosion resistance that lends itself to long-term durability even when subjected to processes such as heat treatments, soldering, welding, melting, and laser etching.

SUMMARY

Embodiments of the present invention provide metal alloy compositions that possess a grey gold hue and other properties suitable for use in making ornamental jewelry, jewelry casting, and other applications. Metal alloy compositions according to embodiments of the present invention comprise effective amounts of gold, palladium, and silver. In some embodiments, the gold, palladium, and silver are combined with one or more other constituent metals. The above and other objects and advantages of the present invention will be apparent upon consideration of the following detailed description.

DETAILED DESCRIPTION

Embodiments of the invention are generally related to metal alloy compositions that possess a grey gold hue, and more particularly, to metal alloy compositions comprising gold, palladium, and silver.

In one embodiment, the metal alloy composition comprises about 58.50% by weight gold, about 20.10% to about 23.59% by weight palladium, and about 20.00% to about 23.70% by weight silver. One or more other constituent metals, including indium, copper, and/or nickel, can be added to influence properties of the alloy such as hue, castability, ductility, strength, hardness, tarnish, and corrosion resistance. For example, in accordance with an embodiment, a metal alloy composition comprising about 58.50% by weight gold, about 20.10% to about 23.59% by weight palladium, and about 20.00% to about 23.70% by weight silver, can additionally include 0% to about 1.0% by weight indium, 0% to about 1.0% by weight copper, and/or 0% to about 1.0% by weight nickel.

In one embodiment, the metal alloy composition comprises about 58.50% to about 59.33% by weight gold, about 20.10% to about 30.28% by weight palladium, and about 1.03% to about 23.70% by weight silver. One or more other constituent metals, including indium, copper, nickel, zinc, and/or bismuth, can be added to influence properties of the alloy such as hue, castability, ductility, strength, hardness, tarnish, and corrosion resistance. For example, in accordance with an embodiment, a metal alloy composition comprising about 58.50% to about 59.33% by weight gold, about 20.10% to about 30.28% by weight palladium, and about 1.03% to about 23.70% by weight silver, can additionally include 0% to about 1.0% by weight indium, 0% to about 1.0% by weight copper, 0% to about 1.0% by weight nickel, 0% to about 2.19% by weight zinc, and/or 0% to about 0.11% by weight bismuth.

In embodiments, the metal alloy composition comprises about 50% to about 60% by weight gold, about 20% to about 40% by weight palladium, about 0.1% to about 11% by weight silver, 0% to about 17% by weight copper, 0% to about 13% by weight zinc, and 0% to about 10% by weight bismuth.

In a particular embodiment, the metal alloy composition comprises about 59% by weight gold, about 30% by weight palladium, about 1% by weight silver, about 7% by weight copper, about 2% by weight zinc, and about 0.1% by weight bismuth.

In a particular embodiment, the metal alloy composition comprises 59.33%±1.07% by weight gold, 30.28%±0.33% by weight palladium, 1.03%±0.19% by weight silver, 7.06%±0.20% by weight copper, 2.19%±0.22% by weight zinc, and 0.11%±0.14% by weight bismuth.

In a particular embodiment, the metal alloy composition comprises 59.33% by weight gold, 30.28% by weight palladium, 1.03% by weight silver, 7.06% by weight copper, 2.19% by weight zinc, and 0.11% by weight bismuth.

Metal alloy compositions according to embodiments of the present invention can be prepared by techniques well known in the art. For example, measured (by weight) amounts of gold, palladium, and silver, and one or more other constituents, such as indium, copper, and/or nickel, can be placed in a heating vessel. These metals can then be melted together using any conventional melting technique. When the metals have been heated to a temperature at which all the material is liquid, the mixture can be allowed to cool and cast into a suitable mold. After cooling, the alloy can be fabricated into suitable shapes for jewelry items and jewelry components, such as rings, bracelets, necklaces, earrings, accessories, and the like.

The following examples present illustrative but non-limiting embodiments of the present invention. Unless otherwise indicated in the examples and elsewhere in the specification and claims, all parts and percentages are by weight.

Example 1

An alloy is prepared having the following composition (percentages are by weight):

| | |
|---|---|
| Gold | 58.50% |
| Palladium | 20.10% |
| Silver | 20.00% |
| Indium | 00.79% |
| Copper | 00.45% |

Example 2

An alloy is prepared having the following composition (percentages are by weight):

| | |
|---|---|
| Gold | 58.50% |
| Palladium | 20.87% |
| Silver | 20.70% |

Example 3

An alloy is prepared having the following composition (percentages are by weight):

| | |
|---|---|
| Gold | 58.50% |
| Palladium | 23.59% |
| Silver | 23.70% |
| Nickel | 00.47% |

Each of these example alloys are found to have a grey gold hue, and found to have other suitable properties, including castability, ductility, strength, hardness, tarnish, and corrosion resistance, for the making of ornamental jewelry.

Example 4

An alloy was prepared by measuring (by weight) amounts of gold, palladium, and silver, and other constituents including copper, zinc, and bismuth, and placing them in a heating vessel. The metals were melted together and heated to a temperature at which all the material was liquid. The mixture was allowed to cool and was cast into one or more suitable molds to produce three rings.

This example alloy was found to have a grey gold hue, and found to have other suitable properties, including castability, ductility, strength, hardness, tarnish, and corrosion resistance, for the making of rings. Metal surface color can be measured using e.g. a spectrophotometer or colorimeter, or by comparison to standard color samples. A spectrophotometer, for example, can quantitatively measure the wavelength-wise reflectance of the alloy surface.

To prepare the alloy for testing, the rings were cut, mounted in cross-section, and wet ground and polished in accordance with the American Society for Testing and Materials standard guide for preparation of metallographic specimens (ASTM E3-11).

The prepared alloy was submitted to chemical content evaluation and found to have the following composition (percentages are by weight):

| | |
|---|---|
| Gold | 59.33% |
| Palladium | 30.28% |
| Copper | 7.06% |
| Zinc | 2.19% |
| Silver | 1.03% |
| Bismuth | 0.11% |

The prepared alloy was tested in accordance with the American Society for Testing and Materials standard test method for microindentation hardness of materials (ASTM E384-17), using a Buehler® Micromet® hardness test machine, which produced the following results:

| Individual Hardness Values, $HV_{500\ gf}$ | | | | | | Average, $HV_{500\ gf}$ |
|---|---|---|---|---|---|---|
| 181.2 | 183.1 | 176.6 | 173.2 | 181.3 | 171.7 | 178 |

While the invention has been described in relation to its preferred embodiments, it is to be understood that various modifications thereof will become apparent to those skilled in the art. The foregoing disclosure is not intended or to be construed to limit the present invention, or to otherwise exclude any such other embodiments, adaptations, variations, and equivalent arrangements, the present invention being limited only by the claims appended hereto and equivalents thereof.

The ranges provided herein include the stated range and any value or sub-range within the state range. In addition, while particular example alloy compositions have been described herein, other compositions are considered to be within the scope of the present invention, including compositions with other percentages by weight of one or more of the constituent elements, where such compositions possess suitable properties as described above.

What is claimed is:

1. An alloy consisting of:

from 50% to 60% by weight gold, from 20% to 40% by weight palladium, from 0.1% to 11% by weight silver, from greater than 0 to 17% by weight copper, from greater than 0 to 13% by weight zinc, and from greater than 0 to 10% by weight bismuth.

2. An alloy consisting of:

from 58.50% to 59.33% by weight gold, from 20.10% to 30.28% by weight palladium, from 20.00% to 23.70% by weight silver, from greater than 0 to 1.0% by weight copper, and from greater than 0 to 1.0% by weight indium.

3. An alloy consisting of:

from 58.50% to 59.33% by weight gold, from 20.10% to 30.28% by weight palladium, from 20.00% to 23.70% by weight silver, from greater than 0 to 1.0% by weight copper, and from greater than 0 to 1.0% by weight nickel.

4. An alloy consisting of:

from 58.50% to 59.33% by weight gold, from 20.10% to 30.28% by weight palladium, from 20.00% to 23.70% by weight silver, from greater than 0 to 1.0% by weight copper, from greater than 0 to less than 1.4% zinc, from greater than 0 to 0.11% bismuth, from greater than 0 to 1.0% nickel, and from greater than 0 to 1.0% indium.

5. An alloy consisting of:

from 58.50% to 59.33% by weight gold, from 20.10% to 30.28% by weight palladium, from 1.03% to 23.70% by weight silver, from greater than 0 to 1.0% by weight copper, from greater than 0 to 2.19% zinc, from greater than 0 to 0.11% bismuth, from greater than 0 to 1.0% nickel, and from greater than 0 to 1.0% indium.

6. The alloy of claim 1, wherein the alloy has a grey gold hue.

7. The alloy of claim 1 having 60% by weight gold.

8. The alloy of claim 1 having 30% by weight palladium.

9. The alloy of claim 1 having 1% by weight silver.

10. The alloy of claim 1 having 6.86% to 7.26% by weight copper.

11. The alloy of claim 1 having 1.97% to 2.41% by weight zinc.

12. The alloy of claim 1 having 0.1% to 0.25% by weight bismuth.

13. An item of jewelry comprising at least one component made of an alloy of claim 1.

* * * * *